US007619517B2

(12) United States Patent
Tracy

(10) Patent No.: US 7,619,517 B2
(45) Date of Patent: Nov. 17, 2009

(54) ALARM FOR SELECTIVELY DETECTING INTRUSIONS BY PERSONS

(75) Inventor: Larry Tracy, Auburn, CA (US)

(73) Assignee: Inet Consulting Limited Company, Yokohama (JP)

( * ) Notice: Subject to any disclaimer, the term of this patent is extended or adjusted under 35 U.S.C. 154(b) by 204 days.

(21) Appl. No.: 11/239,971

(22) Filed: Sep. 30, 2005

(65) Prior Publication Data

US 2007/0075860 A1 Apr. 5, 2007

(51) Int. Cl.
*G08B 13/18* (2006.01)

(52) U.S. Cl. ..... 340/556; 340/541; 340/550; 340/552; 340/555; 340/557; 340/565; 340/573.1

(58) Field of Classification Search ..... 340/541, 340/556, 541.1, 541.2, 555, 557, 505, 539.23, 340/550, 552, 553, 561, 567, 573.1, 565; 356/613, 634, 635, 638
See application file for complete search history.

(56) References Cited

U.S. PATENT DOCUMENTS 4,249,074 A * 2/1981 Zettler et al. ..... 250/221
4,516,115 A * 5/1985 Frigon et al. ..... 340/556
4,931,631 A * 6/1990 Jackson ..... 250/221
5,101,194 A 3/1992 Sheffer
5,253,183 A * 10/1993 Inoue et al. ..... 356/319
5,578,988 A * 11/1996 Hoseit et al. ..... 340/522
6,211,522 B1 * 4/2001 Kotlicki et al. ..... 250/353
6,909,370 B2 6/2005 Nakamura et al.
6,943,685 B2 * 9/2005 Seo ..... 340/541
7,034,675 B2 * 4/2006 DiPoala et al. ..... 340/522

OTHER PUBLICATIONS

PCT Search Report and Written Opinion dated May 8, 2007 corresponding to the related PCT US06/34834.

* cited by examiner

*Primary Examiner*—Daryl Pope
(74) *Attorney, Agent, or Firm*—DLA Piper LLP (US)

(57) ABSTRACT

Improved alarm system that is able to distinguish intrusions by persons from intrusions by others, such as nonhuman animals and inanimate objects. Multiple sensors are placed in a vertically aligned array, so that each sensor monitors at a different elevation. As animals and other objects generally have different sizes and shapes than humans, the vertically spaced sensors will detect different intrusion patterns than the intrusion patterns typically generated by a human. By analyzing these different intrusion profiles and only signaling an alarm when a profile resembling an intrusion by a person occurs, a number of false alarms can be avoided.

29 Claims, 2 Drawing Sheets

ALARM FOR SELECTIVELY DETECTING INTRUSIONS BY PERSONS

BRIEF DESCRIPTION OF THE INVENTION

This invention relates generally to alarm systems. More specifically, this invention relates to alarm systems having the ability to selectively detect intrusions by persons.

BACKGROUND OF THE INVENTION

Conventional alarm systems are commonly used to detect and deter intrusions such as break-ins or trespasses. Such alarm systems often employ sensors positioned to monitor a location or region, and trigger an alarm when the sensor detects a break-in or trespass into that region. These sensors are often known sensing elements such as photoelectric beam sensors that detect intrusions when their photoelectric input is disrupted, passive infrared (PIR) sensors that detect infrared radiation emitted by would be intruders, or the like.

While such alarm systems are often effective in detecting and deterring intrusions, they suffer from certain drawbacks. One notable drawback is a propensity for "false alarms." That is, often the only intrusions of interest are those by persons. Wandering animals, birds, or even falling leaves are often of no cause for concern, yet are commonly detected by an alarm's sensors, triggering an alarm when in fact no real cause for concern exists.

Accordingly, it is desirable to develop alarm systems that have a reduced propensity for detecting false alarms. More specifically, it is desirable to develop alarm systems capable of determining whether a detected intrusion is a potentially undesirable intrusion by a person, or a more harmless intrusion by an animal or inanimate object.

SUMMARY OF THE INVENTION

The invention can be implemented in numerous ways, including as a method and as a system. Various embodiments of the invention are discussed below.

As a selective intrusion detection system for selectively detecting an intrusion by a person, one embodiment of the invention comprises a plurality of photobeam detectors each configured to detect an intrusion into a separate region. Also included is a controller in electrical communication with the plurality of photobeam detectors, the controller configured to identify an intrusion by the person into the regions, the intrusion by the person identified according to patterns in the detected intrusions into the separate regions.

As an intrusion detection system, another embodiment of the invention comprises a plurality of photobeam detectors vertically distributed so as to detect a profile of an object intruding into a region, as well as a controller in electrical communication with the plurality of photobeam detectors, and configured to analyze the profile so as to determine whether the object is likely a person.

As a method of selectively detecting an intrusion into a region, another embodiment of the invention comprises detecting, from a plurality of photobeam sensors, one or more intrusions into a plurality of separate regions, and determining a pattern in the detected intrusions. A type of intrusion is determined according to the determined pattern in the detected intrusions.

Other aspects and advantages of the invention will become apparent from the following detailed description taken in conjunction with the accompanying drawings which illustrate, by way of example, the principles of the invention.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION OF EMBODIMENTS OF THE INVENTION

The invention relates to an improved alarm system that is able to distinguish intrusions by persons from intrusions by others, such as nonhuman animals and inanimate objects. Multiple sensors are placed in a vertically aligned array, so that each sensor monitors at a different elevation. As animals and other objects generally have different sizes and shapes than humans, the vertically spaced sensors will detect different intrusion patterns than the intrusion patterns typically generated by a human. That is, a human, due to his or her size and generally upright posture, will generally trigger each sensor at approximately the same time, with perhaps some slight variation due to the movement of his/her limbs. In contrast, animals such as dogs, deer, bears, and the like move with their heads and necks positioned forward of their legs. Accordingly, they will first trigger upper sensors that detect their heads, then lower sensors that detect their legs. This intrusion profile is different than that of a human, and can be used to distinguish between the two. Also, smaller animals such as birds and dogs may only trigger some sensors and not others. Similarly, inanimate objects such as leaves may trigger only some of the sensors, or will trigger the sensors in a sequential downward pattern as they fall. It can be observed that all of these generate different intrusion patterns than that generated by a typical human. By analyzing these different intrusion profiles and only signaling an alarm when a profile resembling an intrusion by a person occurs, a number of false alarms can be avoided.

Figure 1:
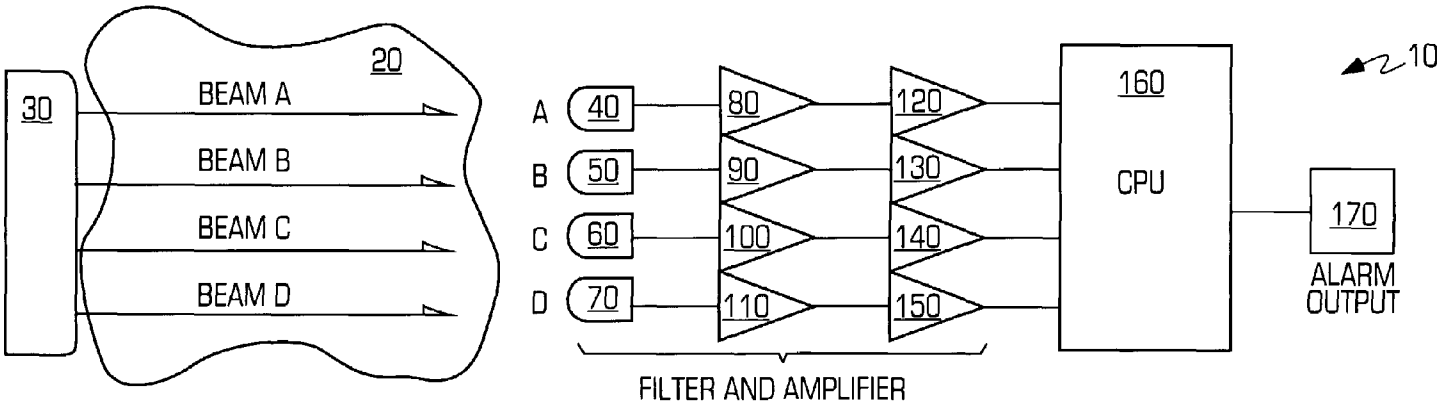
FIG. 1 illustrates a block diagram of an alarm system in accordance with embodiments of the invention.

FIG. 1 illustrates a block diagram of an alarm system in accordance with embodiments of the invention. The alarm system 10 monitors a region 20 for intrusions with a transmitter 30 that transmits beams of electromagnetic energy (shown here as A-D) to corresponding sensors 40-70. The output from these sensors 40-70 is passed through filters 80-110 and amplifiers 120-150 for conditioning of their signals as appropriate, and then transmitted to a central processing unit (CPU) 160 that acts as a controller, analyzing the signals from the sensors 40-70. The controller or CPU 160 monitors the output of the sensors 40-70 for detected intrusions, and when intrusions are detected by one or more of the sensors 40-70, analyzes the pattern of the detected intrusions. If the pattern or profile matches that which would be typically generated by a human, the CPU 160 sends an alarm signal to the alarm output 170, which can be a speaker, visual output, or any other device for alerting others to the presence of an intruder. In a preferred embodiment, each of the sensors 40-70 is a photobeam detector.

Figure 2:
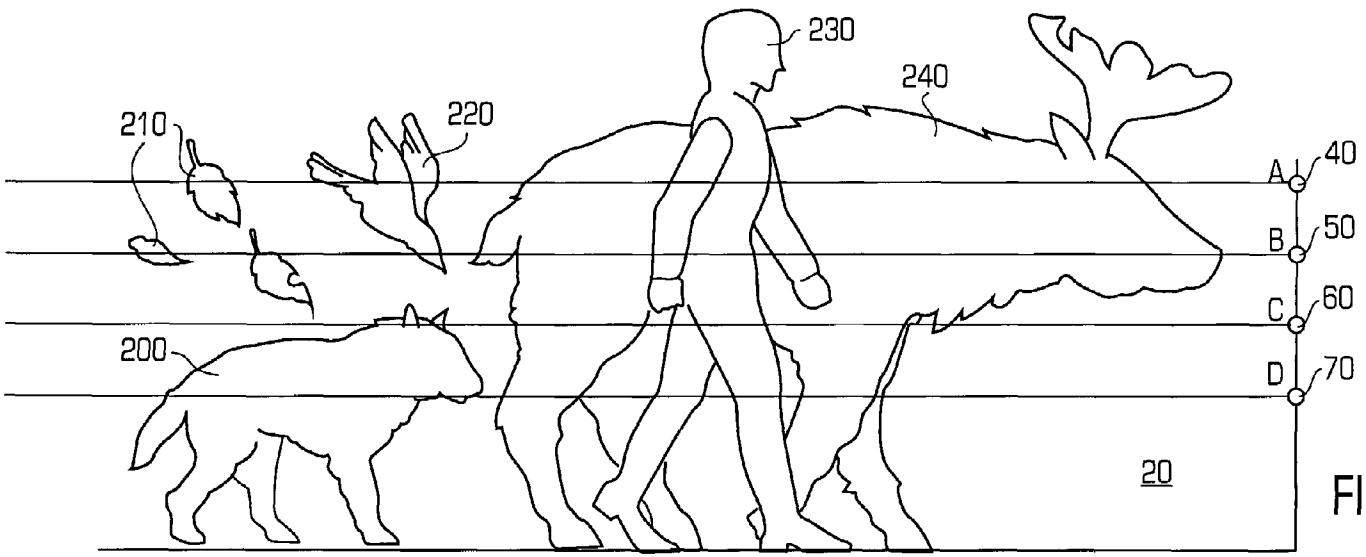
FIG. 2 illustrates sensors placed in accordance with embodiments of the invention, as well as the operation of these sensors in detecting intrusions by various objects such as people, animals, and falling leaves.

FIG. 2 illustrates further details of the operation of the alarm system 10, showing the placement and operation of sensors 40-70. In operation, the sensors 40-70 are placed so as to monitor the region 20 for intrusions by various objects such as humans and animals. Such objects can, for purposes of illustration, include a dog 200, falling leaves 210, a bird 220, a human, 230, and a larger animal such as a deer 240. In one embodiment, the sensors 40-70 are placed in a vertically spaced configuration so that lower sensors 60-70 can detect the lower extremities of a human 230 or larger animal like a deer 240, while also detecting the body of a smaller animal like a dog 200. Similarly, the upper sensors 40-50 are placed at a height allowing them to detect the body and upper extremities of a person 230 or the head and body of a larger animal like a deer 240. At this height, the upper sensors 40-50 may detect falling objects like leaves 210 and flying objects like birds 220, but are placed too high to detect small animals like dogs 200.

When these objects 200-240 intrude upon the region 20, they will each cross beams A-D at different times and in different sequences, meaning that sensors 40-70 will detect intrusions in patterns characteristic of each different object. Such patterns, that can also be thought of as representing the profiles of such objects as they pass through beams A-D, can be used to identify the object, so that an alarm can be sounded when a human 230 is identified, but avoided when a different object 210-220, 240 is identified. FIGS. 3A-3E illustrate exemplary profiles of signals generated by the sensors 40-70 in response to intrusions by the dog 200, leaves 210, bird 220, human 230, and deer 240, respectively. Such exemplary profiles highlight how different objects generate different such profiles, and accordingly how the alarm system 10 can distinguish persons 230 from other objects.

Figures 3A, 3B, 3C, 3D:
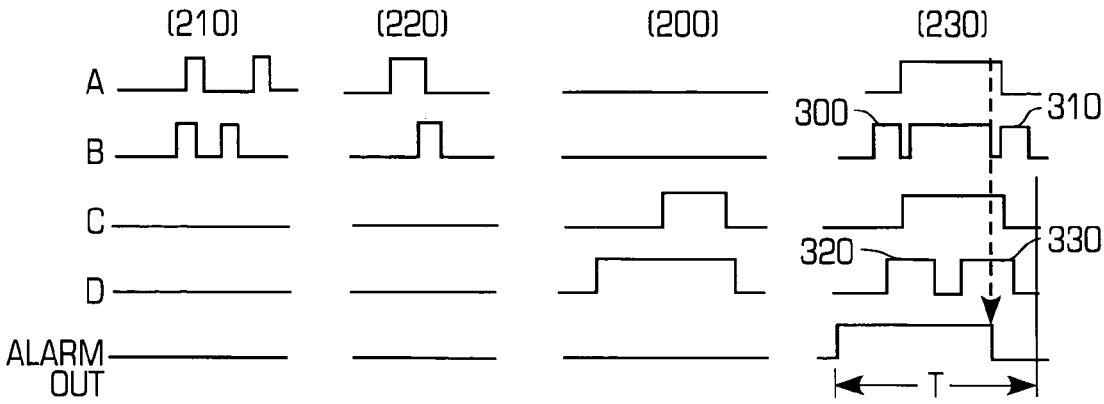
FIGS. 3A-3E illustrate exemplary profiles of signals generated by the sensors of FIG. 2.

FIG. 3A illustrates an exemplary profile of signals generated by falling leaves 210. As can be observed, falling leaves 210 will typically cross the upper beams A-B, but not the lower beams C-D, and even if they cross most or all beams A-D, they will typically do so by falling across beams A-D sequentially. Accordingly, leaves 210 will often generate a pattern of intrusion signals such as that shown in FIG. 3A, with only the upper beams A-B (i.e., upper sensors 40-50) detecting an intrusion.

FIG. 3B illustrates an exemplary profile of signals generated by a bird 220. Flying animals such as birds 220 will, like leaves 210, often intersect only the upper beams A-B or, even if they are diving across most or all beams A-D, will intersect the highest beam A before the next-highest beam(s) B. Thus, birds 220 will commonly generate a pattern of intrusion signals such as that shown, with only the upper beams A-B detecting an intrusion, and the uppermost beam A detecting an intrusion prior to next uppermost beam B.

FIG. 3C illustrates an exemplary profile of signals generated by a dog 200. As can be observed, the dog 200 is too small to trigger the upper sensors 40-50, but is large enough to trigger the lower sensors 60-70 with its head/body. Also, as the body of a dog 200 is longer/larger than that of a bird 220 or leaf 210, the dog 200 typically interrupts the beams C-D for a longer time than will a bird 220 or leaf 210. Accordingly, dogs 200 will often generate a pattern like that shown in FIG. 3C, where only the lower beams A-B detect an intrusion, and where the intrusion is of a relatively long duration.

FIG. 3D illustrates an exemplary profile of signals generated by a human 230. The sensors 40-70 are each placed below the height of a typical human 230, with the result that the upright-walking human 230, whose width does not vary significantly with height, will interrupt each beam A-D at approximately the same time and for the same duration. Thus, the profile of FIG. 3D, in which interruptions are detected by each sensor 40-70 for generally the same amount of time, is often characteristic of an intrusion by a human 230, and can thus be used as a basis for identifying human intrusions.

One of ordinary skill in the art will observe that the legs and arms of the human 230 will also interrupt the beams A-D, causing short-duration indications of an intrusion. Such additional short-duration intrusions typically occur within roughly the same time as the other intrusions shown in FIG. 3D, and can thus be neglected or, as they typically occur in most human intrusions into region 20, can be considered as part of the profile characteristic of an intruding person 230.

Figure 3E:
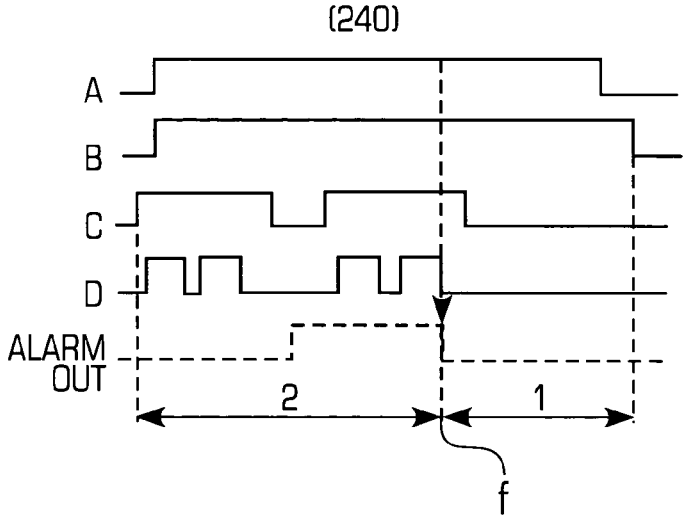

FIG. 3E illustrates an exemplary profile generated by a deer 240 or other large animal. While the deer 240 is large enough to trigger all sensors 40-70, note that the general shape of a deer 240, with its head and neck protruding forward from the remainder of its body, causes it to generally interrupt the upper beams A-B first with its neck/head, followed later by interrupting all beams A-D simultaneously with its body and legs. As is further illustrated in FIG. 3E, region 1 represents the intrusions by the neck/head into the areas monitored by upper sensors 40-50, followed by region 2, in which the body of the deer 240 interrupts all sensors 40-70, with (often characteristic) interruptions of the lower beam D caused by the legs. This profile, with upper sensors 40-50 detecting intrusions before and during the same period as lower sensors 60-70 detect an intrusion, is typical of many larger animals and can be employed to distinguish these types of intrusions from those caused by humans 230.

Embodiments of the invention thus analyze the various profiles generated by different objects as they intrude upon the region 20. As different objects often generate distinctive profiles, an analysis of the pattern by which sensors 40-70 detect intrusions can often differentiate between humans and others. The invention thus includes the analysis of the patterns in signals generated by sensors 40-70, and the identification of human intrusions according to the particular pattern observed.

It should be noted that the analysis of such patterns can be accomplished in many different ways consistent with the invention. For example, as FIG. 3D illustrates that human intrusions typically generate a pattern of simultaneous intrusions across all sensors 40-70, CPU 160 can simply analyze the output signals of sensors 40-70 to determine whether all sensors 40-70 detect an intrusion during substantially the entire time period between the beginning of the first detected intrusion and the end of the last remaining intrusion (shown as time period T in FIG. 3D). One of ordinary skill in the art will realize that the invention includes any manner of determining that the sensors 40-70 have each detected intrusions during this time period. As one example, the invention includes comparison of the pattern to a threshold amount of the time period T by which each sensor, or all sensors in aggregate, detect an intrusion. One of ordinary skill in the art will also realize that the invention includes other ways of recognizing the pattern of FIG. 3D. For instance, the CPU 160 can employ known pattern recognition methods to compare detected patterns to a predetermined, stored pattern such as that of FIG. 3D. The CPU 160 can also be programmed to parse detected patterns more finely, so as to initiate an alarm only when a pattern closely resembling that of FIG. 3D is detected. For example, an alarm can be initiated only when a pattern is detected in which all sensors detect intrusions substantially simultaneously, and when intrusions 300, 310 indicating the arms of the person 230 are detected, as well as intrusions 320, 330 indicating legs.

It should also be noted that the invention is not limited to the number of sensors shown in FIG. 2, nor is it limited to the particular sensor distribution shown there. Rather, one of ordinary skill in the art will realize that the invention includes the use of any number of sensors 40-70, and not just four. Similarly, the invention is not limited to an exactly evenly spaced set of sensors 40-70 that are spaced apart in a precise vertical line. Instead, the invention simply includes any distribution of sensors 40-70 capable of accurately detecting the characteristic profile of a human 230 as it differs from that of other objects. One of ordinary skill in the art will also realize that photoelectric beam sensors are utilized for purposes of explanation, the invention is not so limited. Instead, the invention includes the use of any sensor capable of detecting intrusions by humans and other objects. As an example, the invention includes the use of distributed arrays of not only photobeam detectors, but also PIR sensors and microwave detectors.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. Many modifications and variations are possible in view of the above teachings. For example, the sensors 40-70 can be any sensors capable of detecting intrusions into region 20. Similarly, the sensors can be distributed in any manner allowing them to detect a characteristic pattern left by an intruding object. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A selective intrusion detection system for selectively detecting an intrusion by a person, comprising:

a plurality of photobeam sources;

a plurality of photobeam detectors for detecting intrusion into a plurality of separate regions, wherein each photobeam detector being paired with an associated photobeam source, for detecting an intrusion into a separate region; and a controller in electrical communication with the plurality of photobeam detectors, the controller configured to identify an intrusion by the person into the plurality of separate regions, the intrusion by the person identified according to patterns in the detected intrusions into the separate regions, each pattern characterized as a collection of pulse electrical signals generated by the plurality of photobeam detectors, wherein each pulse electrical signal is characterized by time and duration corresponding to interruption of the photobeams incident on the detectors;

wherein the patterns are derived from receipt and processing of the collective outputs of all the photobeam detectors by the controller; and wherein the controller analyzes a pattern corresponding to the intrusion by the person using time and duration of known patterns of pulse electrical signals to differentiate human intrusions from non-human intrusions.

2. The selective intrusion detection system of claim 1 wherein the controller is further configured to distinguish between the intrusion by the person and an intrusion by either of an animal and an object into one or more of the regions.

3. The selective intrusion detection system of claim 2 wherein each of the separate regions is offset vertically from each other of the separate regions, and is generally located at an elevation facilitating an intersection by the person and the animal and the object upon the separate region.

4. The selective intrusion detection system of claim 3 wherein the controller is further configured to identify the intrusion by the person according to generally simultaneous intrusions into each of the vertically offset regions.

5. The selective intrusion detection system of claim 3 wherein the controller is further configured to identify the intrusion by either of an animal and an object according to intrusions into less than all of the vertically offset regions.

6. The selective intrusion detection system of claim 3:

wherein the vertically offset regions include upper regions generally located at higher elevations than lower regions; and wherein the controller is further configured to identify the intrusion by either of an animal and an object according to intrusions into one or more of the upper regions, followed by intrusions into one or more of the lower regions.

7. The selective intrusion detection system of claim 3 wherein the controller is further configured to identify the intrusion by the person by comparing the intrusions into the vertically offset regions to a predetermined pattern by which the person intersects the vertically offset regions.

8. The selective intrusion detection system of claim 1 wherein the controller is further configured to transmit an alarm signal upon identifying the intrusion by the person.

9. An intrusion detection system, comprising:

a plurality of photobeam sources;

a plurality of photobeam detectors for detecting intrusion into a plurality of separate regions and vertically distributed so as to detect a profile of an object intruding into a region, wherein each photobeam detector being paired with an associated photobeam source for detecting an intrusion into a separate region; and a controller in electrical communication with the plurality of photobeam detectors, and configured to analyze the profile so as to determine whether the object is likely a person, the profile being identified according to patterns in the detected intrusions into the separate regions, each pattern characterized as a collection of pulse electrical signals generated by the plurality of photobeam detectors, wherein each pulse electrical signal is characterized by time and duration corresponding to interruption of the photobeams incident on the detectors; wherein the profile is derived from receipt and processing of the collective outputs of all the photobeam detectors by the controller; and wherein the controller analyzes a pattern corresponding to the detected profile using time and duration of known patterns of pulse electrical signals to differentiate human intrusions from non-human intrusions.

10. The intrusion detection system of claim 9 wherein each photobeam detector of the plurality of photobeam detectors is generally vertically aligned with each other photobeam detector of the plurality of photobeam detectors, and is located at an elevation facilitating the detection of the profile of the object intruding into the region.

11. The intrusion detection system of claim 10 wherein the controller is further configured to determine that the object is likely a person according to a detected profile corresponding to generally simultaneous intrusions detected by each of the vertically offset photobeam detectors.

12. The intrusion detection system of claim 10 wherein the controller is further configured to determine that the object is likely not a person according to a detected profile corresponding to intrusions detected by less than all of the vertically offset photobeam detectors.

13. The intrusion detection system of claim 10:

wherein the vertically offset photobeam detectors include upper photobeam detectors generally located at higher elevations than lower photobeam detectors; and wherein the controller is further configured to determine that the object is likely not a person according to a detected profile corresponding to intrusions detected by one or more of the upper photobeam detectors, followed by intrusions detected by one or more of the lower photobeam detectors.

14. The intrusion detection system of claim 10 wherein the controller is further configured to compare the profile to a predetermined profile corresponding to a profile generated by a person intruding into the region.

15. The intrusion detection system of claim 9 wherein the controller is further configured to transmit an alarm signal upon determining that the object is likely a person.

16. A method of selectively detecting an intrusion into a region, comprising:

detecting, from a plurality of photobeam sensors each paired with an associated photobeam source, one or more intrusions into a plurality of separate regions, wherein each separate region is associated with a photobeam sensor and photobeam source that are arranged to detect intrusion into that region;

determining a pattern in the detected intrusions, wherein patterns are derived from receipt and processing of the collective outputs of all the photobeam sensors by the a controller, each pattern characterized as a collection of pulse electrical signals generated by the plurality of photobeam detectors, wherein each pulse electrical signal is characterized by time and duration corresponding to interruption of the photobeams incident on the detectors; and determining a type of intrusion according to the determined pattern in the detected intrusions;

wherein the type of intrusion is determined by analyzing the determined pattern using time and duration of known patterns of pulse electrical signals.

17. The method of claim 16, wherein the determining a type of intrusion further comprises distinguishing an intrusion by a person from an intrusion by either of an animal and an object into one or more of the separate regions.

18. The method of claim 17, wherein each of the separate regions is offset vertically from each other of the separate regions, and wherein each of the separate regions is positioned at an elevation facilitating an intersection by the person and the animal and the object.

19. The method of claim 18 wherein the determining a type of intrusion further comprises identifying the intrusion by a person according to generally simultaneous intrusions into each of the vertically offset regions.

20. The method of claim 18 wherein the determining a type of intrusion further comprises identifying the intrusion by either of an animal and an object according to intrusions into less than all of the vertically offset regions.

21. The method of claim 18:

wherein the vertically offset regions include upper regions generally located at higher elevations than lower regions; and wherein the determining a type of intrusion further comprises identifying the intrusion by either of an animal and an object according to intrusions into one or more of the upper regions, followed by intrusions into one or more of the lower regions.

22. The method of claim 18 wherein the determining a type of intrusion further comprises identifying the intrusion by a person by comparing the intrusions into the vertically offset regions to a predetermined pattern by which the person intersects the vertically offset regions.

23. The method of claim 16 further comprising transmitting an alarm signal upon identifying the intrusion by a person.

24. The system of claim 1 wherein the photobeam sources emit and the photobeam detectors detect infrared light.

25. The system of claim 1 further comprising three or more pairs of photobeam detectors and associated photobeam sources.

26. The system of claim 9 wherein the photobeam sources emit and the photobeam detectors detect infrared light.

27. The system of claim 9 further comprising three or more pairs of photobeam detectors and associated photobeam sources.

28. The method of claim 16, wherein the detecting comprises detecting infrared light emitted by the photobeam sources and received by the photobeam sensors.

29. The method of claim 16 wherein the plurality of separate regions comprises three or more separate regions.

* * * * *